US007121813B2

(12) United States Patent
Choi et al.

(10) Patent No.: US 7,121,813 B2
(45) Date of Patent: Oct. 17, 2006

(54) REVERSE ROTATION PREVENTING STRUCTURE OF CENTRIFUGAL COMPRESSOR

(75) Inventors: Moon Chang Choi, Gwangmyeong-si (KR); Kwang Ha Suh, Goonpo-si (KR); Young Kwan Kim, Bucheon-si (KR); Yoo Chol Ji, Incheon-si (KR); Dae Sung Wang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/283,049

(22) Filed: Oct. 30, 2002

(65) Prior Publication Data

US 2003/0113215 A1 Jun. 19, 2003

(30) Foreign Application Priority Data

Dec. 13, 2001 (KR) ..... 2001-78932

(51) Int. Cl.
*F04B 49/03* (2006.01)

(52) U.S. Cl. ..... 417/279

(58) Field of Classification Search ..... 417/279, 417/280, 223, 366, 371, 247, 26
See application file for complete search history.

(56) References Cited

U.S. PATENT DOCUMENTS

| | | | | |
|---|---|---|---|---|
| 1,958,410 | A * | 5/1934 | Schaeren | 417/279 |
| 3,195,556 | A * | 7/1965 | Norstrud et al. | 137/469 |
| 3,692,432 | A * | 9/1972 | Liang et al. | 417/286 |
| 3,827,827 | A * | 8/1974 | Hill | 417/28 |
| 4,156,578 | A * | 5/1979 | Agar et al. | 415/1 |
| 4,171,708 | A * | 10/1979 | Pareja | 137/115.04 |
| 4,225,288 | A * | 9/1980 | Mugele et al. | 417/2 |
| 4,336,001 | A * | 6/1982 | Andrew et al. | 417/63 |
| 4,493,607 | A * | 1/1985 | Napolitano | 415/11 |
| 4,940,391 | A * | 7/1990 | Elms et al. | 417/12 |
| 5,156,177 | A * | 10/1992 | Bishoff | 137/12 |
| 5,897,299 | A | 4/1999 | Fukunaga | |
| 6,585,493 | B1 * | 7/2003 | Sutton | 417/69 |

FOREIGN PATENT DOCUMENTS

| | | |
|---|---|---|
| JP | 8-312582 | 11/1996 |
| KR | 977003493 | 7/1997 |
| KR | 010081648 | 8/2001 |

OTHER PUBLICATIONS

English Language Abstract of JP 8-312582.
English Language Abstract of KOREAN No. 010081648.
English Language Abstract of KOREAN No. 977003493.

* cited by examiner

*Primary Examiner*—Charles G. Freay
*Assistant Examiner*—Samuel E. Belt
(74) *Attorney, Agent, or Firm*—Greenblum & Bernstein, P.L.C.

(57) ABSTRACT

The invention relates to a reverse rotation preventing structure of a centrifugal compressor. The reverse rotation preventing structure of the centrifugal compressor comprises: a discharge pipeline of the centrifugal compressor; a suction pipeline of the centrifugal compressor; a bypass pipeline for connecting the discharge pipeline and the suction pipeline, wherein a predetermined valve is formed thereon; a control means for controlling an operation of the centrifugal compressor; and a detecting means for generating a predetermined signal to the control means if the operation of the centrifugal compressor is suddenly stopped, thereby opening the bypass pipeline.

11 Claims, 5 Drawing Sheets

REVERSE ROTATION PREVENTING STRUCTURE OF CENTRIFUGAL COMPRESSOR

BACKGROUND OF THE INVENTION

1. Field of the Invention

The present invention relates to a centrifugal compressor, and more particularly, to a reverse rotation preventing structure of a centrifugal compressor, which is capable of preventing a reverse rotation in the compressor caused by a backward flow of a fluid due to a pressure difference between a suction side and a discharge side, when an operation of the compressor is suddenly stopped due to a power failure or a power shutdown caused by an abnormal operation of the compressor.

2. Description of the Related Art

Generally, a compressor is a machine that converts the mechanical energy into the compression energy of a compressive fluid, and is classified into a reciprocating type, a scroll type, a centrifugal (turbo) type and a vane (rotary) type.

Among them, the centrifugal compressor (so-called turbo compressor) sucks a fluid in an axial direction using a rotation force of an impeller and then discharges the fluid in a centrifugal direction, to thereby perform a compression operation. The centrifugal compressor is classified into two types, i.e., one-stage centrifugal compressor and two-stage centrifugal compressor, according to the number of the impellers and the compression chambers. Also, the centrifugal compressor is classified into two types, i.e., a back-to-back type and a face-to-face type, according to the type of the arrangement of the impellers.

Hereinafter, two-stage centrifugal compressor of the face-to-face type will be described with reference to FIG. 1.

Referring to FIG. 1, the centrifugal compressor of the face-to-face type includes a motor housing 1, a first bearing plate 2A and a second bearing plate 2B disposed at both ends of the motor housing 1, a shroud plate 3 mounted on an external face of the first bearing plate 2A, a first compression casing 4A mounted on an external face of the shroud plate 3, a bearing cover 5 mounted on an external face of the second bearing plate 2B, a volute casing 6 covering the bearing cover 5, a second compression casing 4B mounted on an external face of the volute casing 6, and a motor M mounted on the interior of the motor housing 1.

Here, a suction port SP is formed on one side of the motor housing 1 and a discharging port DP is formed on one side of the volute casing 6.

A first compression chamber SC1 is constituted with the shroud plate 3 and the first compression casing 4A, and a second compression chamber SC2 is constituted with the volute casing 6 and the second compression casing 4B.

The motor M providing the rotation force includes a stator MS, a rotor MR mounted on the interior of the stator MS, and a rotating shaft 7 rigidly fixed into the rotor MR. Also, both ends of the rotating shaft 7 of the motor M are passed through the first bearing plate 2A and the second bearing plate 2B, respectively. In particular, the rotating shaft 7 is supported in a radial direction by radial bearings 9A and 9B disposed inside the plates 2A and 2B and is supported in an axial direction by a thrust bearing 10.

A first impeller 8A and a second impeller 8B respectively disposed at the first compression chamber SC1 and the second compression chamber SC2 are attached to both ends of the rotating shaft 7 of the motor M. Further, the impellers 8A and 8B are arranged in the face-to-face type. In other words, the impellers 8A and 8B are arranged to face to each other in a direction of sucking the fluid. A reference number 13 that is not described represents a power supplying line.

According to the conventional two-stage centrifugal, or turbo, compressor of the face-to-face type, a low-temperature and low-pressure refrigerant is sucked into the suction port SP by the rotation of the rotating shaft 7 and the two impellers 8A and 8B. Here, the rotating shaft 7 is rotated by the driving of the motor M, and the two impellers 8A and 8B are connected to both ends of the rotary shaft 7. The sucked refrigerant flows into the first compression chamber SC1 through the first gas passage 11 and is primarily compressed by the first impeller 8A. The primarily compressed refrigerant, so-called provisionally compressed refrigerant, is sucked into the second compression chamber SC2 through the second gas passage 12 and is secondarily compressed by the second impeller 8B, thereby achieving an effective compression operation. The secondarily compressed refrigerant is gathered in the volute casing 6 and is discharged through the discharge port DP.

Therefore, in case where the centrifugal compressor is normally operated, the pressure difference between the suction port SP and the discharge port DP becomes high.

However, there is an occasion that an operation of the compressor is suddenly stopped due to a power failure during the normal compression operation or a power shutdown caused by an abnormal operation of the centrifugal compressor. At this time, to achieve the pressure equilibrium between the high-pressure discharge port DP and the low-pressure suction port SP, the refrigerant abruptly flows backward from the discharge port DP to the suction port SP through the refrigerant passage 12.

By the way, due to the abruptly backward flow of the refrigerant from the discharge port DP to the suction port SP, a reverse torque is instantaneously applied to the impellers 8A and 8B fixed on both ends of the rotating shaft 7. Further, the rotating shaft 7 is also rotated in a reverse direction.

At this time, in case where the impellers 8A and 8B and the rotating shaft 7 are rotated in the reverse direction, there is a problem that a performance of two dynamic-pressure air radial bearings 9A and 9B for supporting a radial load of the rotating shaft is degraded. Also, there is a problem that parts constituting the bearings 9A and 9B may be damaged.

Further, there is a disadvantage that a severe noise occurs due to the abruptly backward flow of the refrigerant from the high-pressure discharge port DP to the low-pressure suction port SP when the operation of the centrifugal compressor is suddenly stopped.

Furthermore, an impulse occurring during the backward flow of the refrigerant as well as the damages to the parts result in a shortening of a durability of the centrifugal compressor.

SUMMARY OF THE INVENTION

Accordingly the present invention has been devised to solve the foregoing problems of the prior art, and it is an object of the invention to provide a reverse rotation preventing structure of a centrifugal compressor, in which a stress that may cause an abnormal noise and a damage to parts of the centrifugal compressor at an emergency stop of the centrifugal compressor can be prevented by forming an additional path that can allow a fluid to be bypassed from a high-pressure side to a low-pressure side when an operation of the centrifugal compressor is suddenly stopped.

Further, it is another object of the present invention to improve a durability of the centrifugal compressor and an operational reliability thereof in the long run.

According to an aspect of the present invention, a reverse rotation preventing structure of a centrifugal compressor comprises: a suction pipe through which a low-pressure fluid sucked into the centrifugal compressor flows; a discharge pipe extended from a discharge port, through which a high-pressure fluid flows; a fluid passage pipe connected between the suction pipe and the discharge pipe, wherein an opening and closing of the fluid passage pipe is controlled by a predetermined bypass valve mounted thereon; and a power-down detecting means for detecting a power-down of the centrifugal compressor and generating a power-down detecting signal for opening the bypass valve, so that the high-temperature refrigerant is allowed to flow to the suction pipe through the fluid passage pipe.

A reverse rotation preventing structure of a centrifugal compressor can prevent an abnormal noise and a damage to parts of the centrifugal compressor by reducing a reverse rotation of a rotating shaft and an abnormal flow of a refrigerant in the centrifugal compressor, which are caused by a backward flow of the refrigerant when an operation of the centrifugal compressor is suddenly stopped. Particularly, the present invention can prevent a dynamic-pressure air bearing for supporting a load of a rotating shaft from being damaged.

BRIEF DESCRIPTION OF THE DRAWINGS

The above object, other features and advantages of the present invention will become more apparent by describing the preferred embodiment thereof with reference to the accompanying drawings, in which.

DETAILED DESCRIPTION OF THE PREFERRED EMBODIMENT

Hereinafter, preferred embodiments relating with a reverse rotation preventing structure of a centrifugal compressor in accordance with the present invention are described in detail with reference to the accompanying drawings. The same reference numbers as the prior art will represent the same elements as the prior art.

Figure 1:
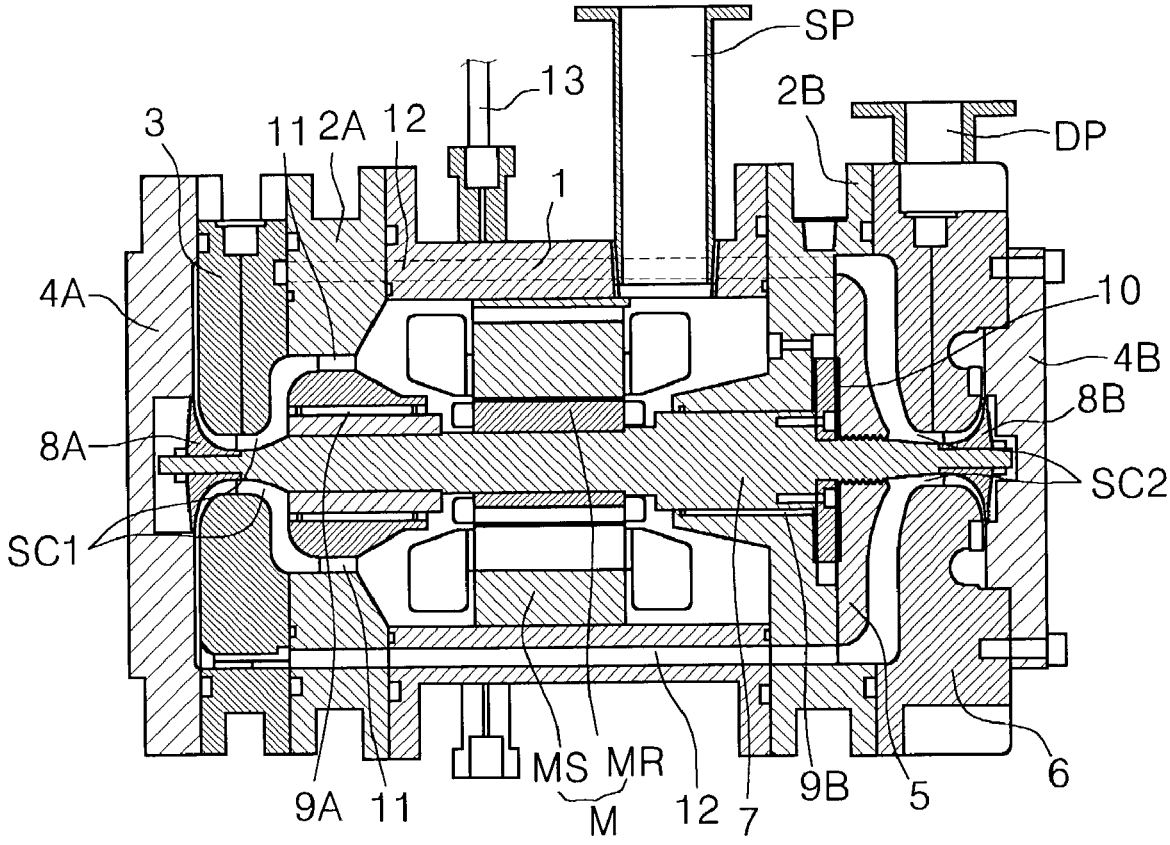
FIG. 1 (Related Art)
FIG. 1 is a sectional view of a conventional two-stage centrifugal compressor.
Figure 2:
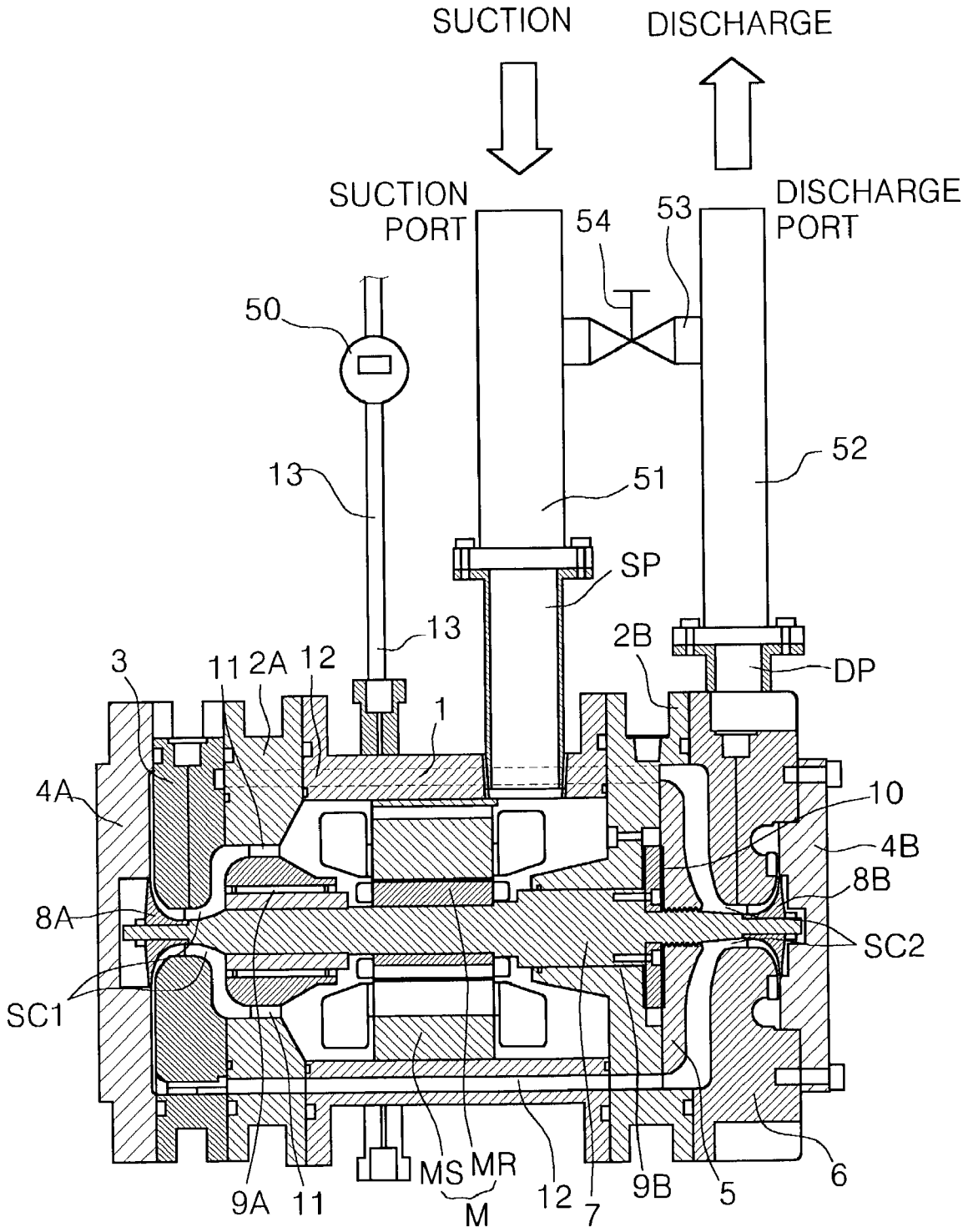
FIG. 2 is a sectional view showing a reverse rotation preventing structure of a centrifugal compressor in accordance with an embodiment of the present invention.

FIG. 2 is a sectional view showing a reverse rotation preventing structure of a centrifugal compressor in accordance with the present invention.

Referring to FIG. 2, the reverse rotation preventing structure of the centrifugal compressor includes a structure for preventing a backward flow of a refrigerant from a discharge port DP to a suction port SP in case where an operation of the compressor is suddenly stopped due to a power failure or a power shutdown caused by an abnormal operation of the centrifugal compressor.

The reverse rotation preventing structure of the centrifugal compressor in accordance with the present invention includes a suction pipe 51 connected to the suction port SP, a discharge pipe 52 connected to the discharge port DP, a fluid passage pipe 53 formed as a connection pipeline between the suction pipe 51 and the discharge pipe 52, and a bypass valve 54 formed on the fluid passage pipe 53.

Also, a power-down detecting unit 50 for detecting a continuously supplied power and a power shutdown is mounted on a power supplying line 13. If the power-down detecting unit 50 detects the power shutdown, the power-down detecting unit 50 transmits a predetermined signal to a control unit and the control unit opens or closes the bypass valve 54 in response to the predetermined signal.

An operation of the centrifugal compressor in accordance with the present invention will be described below.

In case where an external power fails or is shut down due to an abnormal operation of the centrifugal compressor, the power-down detecting unit 50 mounted on the power supplying line 13 detects the power failure or the power shutdown. If the power-down detecting unit 50 detects the power failure or the power shutdown, the control unit allows the bypass valve 54 to be open.

If the bypass valve 54 is open, the high-pressure refrigerant gas of both the discharge pipe 52 and the discharge port DP is bypassed to the suction pipe 51 through the fluid passage pipe 53. If the pressure equilibrium between the suction pipe 51 and the discharge pipe 52 is achieved, the fluid does not flow through the fluid passage pipe 53 any more. In other words, the pressure equilibrium between the suction port SP and the discharge port DP is achieved by the flow of the fluid through the fluid passage pipe 53.

Meanwhile, it is desired that the fluid passage pipe 53 is disposed at the nearest position of the suction port SP and the discharge port DP so that the high-pressure fluid can rapidly flow to the low-pressure side of the centrifugal compressor.

Meanwhile, a check valve that allows the fluid to flow only in one direction can be used as the bypass valve 54 mounted within the fluid passage pipe 53. The check valve is used to prevent the fluid from flowing from the low-pressure side to the high-pressure side in case where an amount of the fluid exceeding the equilibrium state flows from the high-pressure side to the low-pressure side, thereby preventing an occurrence of a vibration within the centrifugal compressor.

Figure 3:
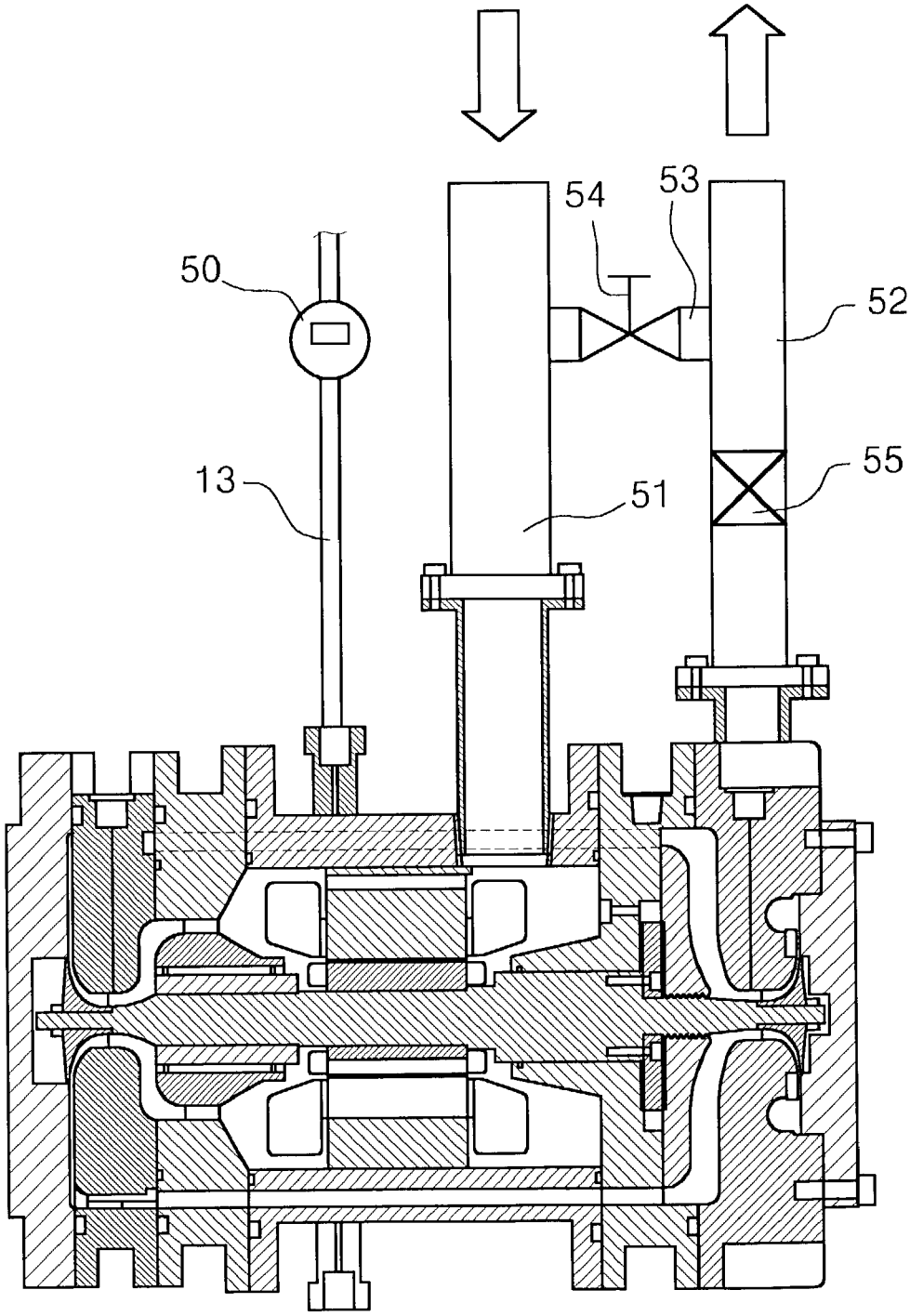
FIG. 3 is a sectional view showing a reverse rotation preventing structure of a centrifugal compressor in accordance with another embodiment of the present invention.

FIG. 3 is a sectional view showing a reverse rotation preventing structure of a centrifugal compressor in accordance with another embodiment of the present invention.

Referring to FIG. 3, if an operation of the compressor is suddenly stopped, the bypass valve 54 is open in response to a signal generated by the power-down detecting unit 50, so that the fluid primarily flows to the suction pipe 51 through the fluid passage pipe 53. Then, to prevent a remaining refrigerant gas of the discharge pipe 52 from flowing backward to the suction port SP through the discharge port DP, the centrifugal compressor of the present invention further includes a check valve 55 formed on a predetermined position between the discharge pipe 52 and the fluid passage pipe 53. At this time, the remaining refrigerant gas of the discharge pipe 52 is the fluid that does not primarily flow to the suction pipe 51 through the fluid passage pipe 53 and remains in the discharge pipe 52.

Hereinafter, an operation of the reverse rotation preventing structure of the centrifugal compressor in accordance with the present invention will be described in detail.

Figure 4:
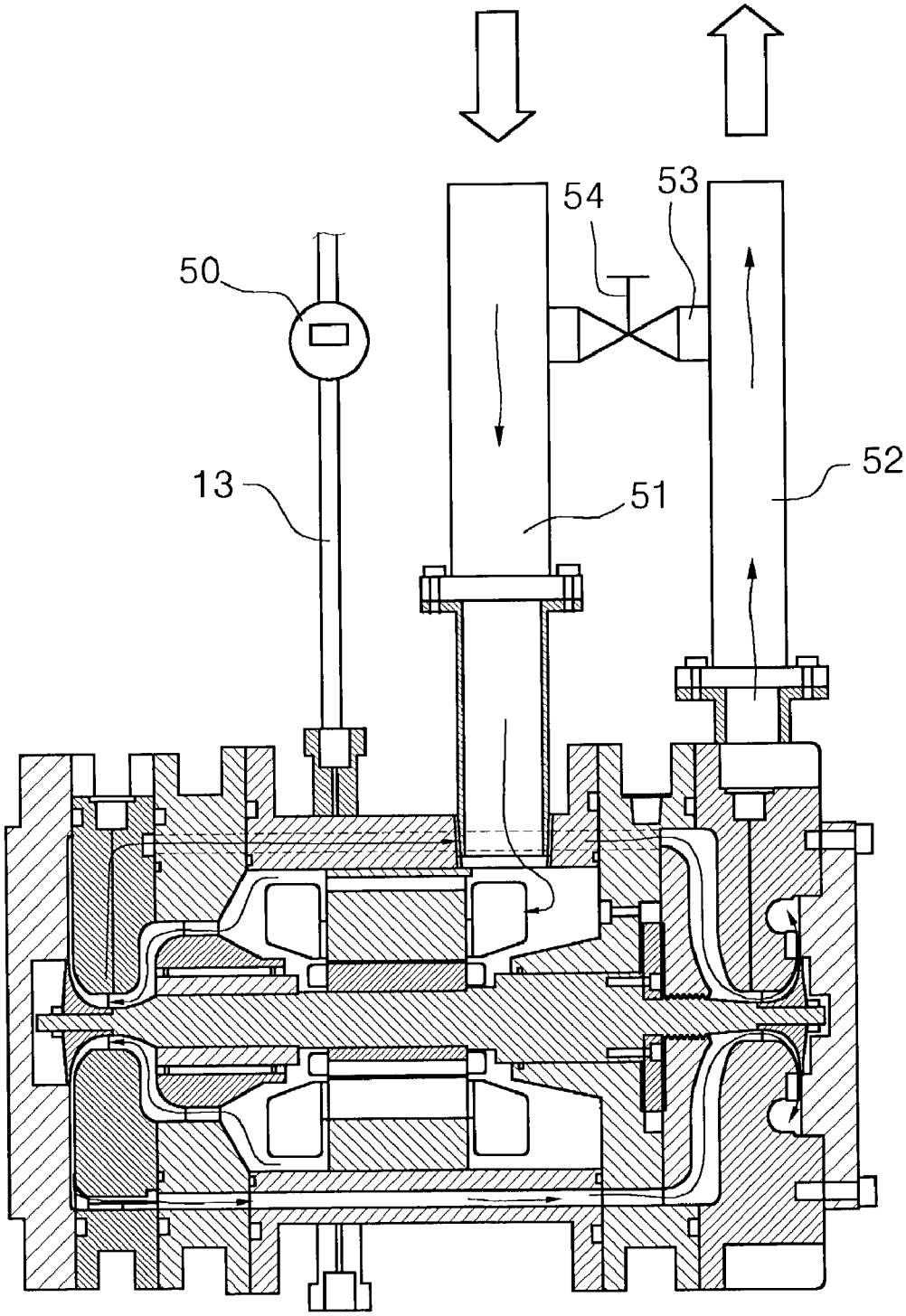
FIG. 4 is a sectional view showing a normal operation state of a centrifugal compressor in accordance with the present invention.
Figure 5:
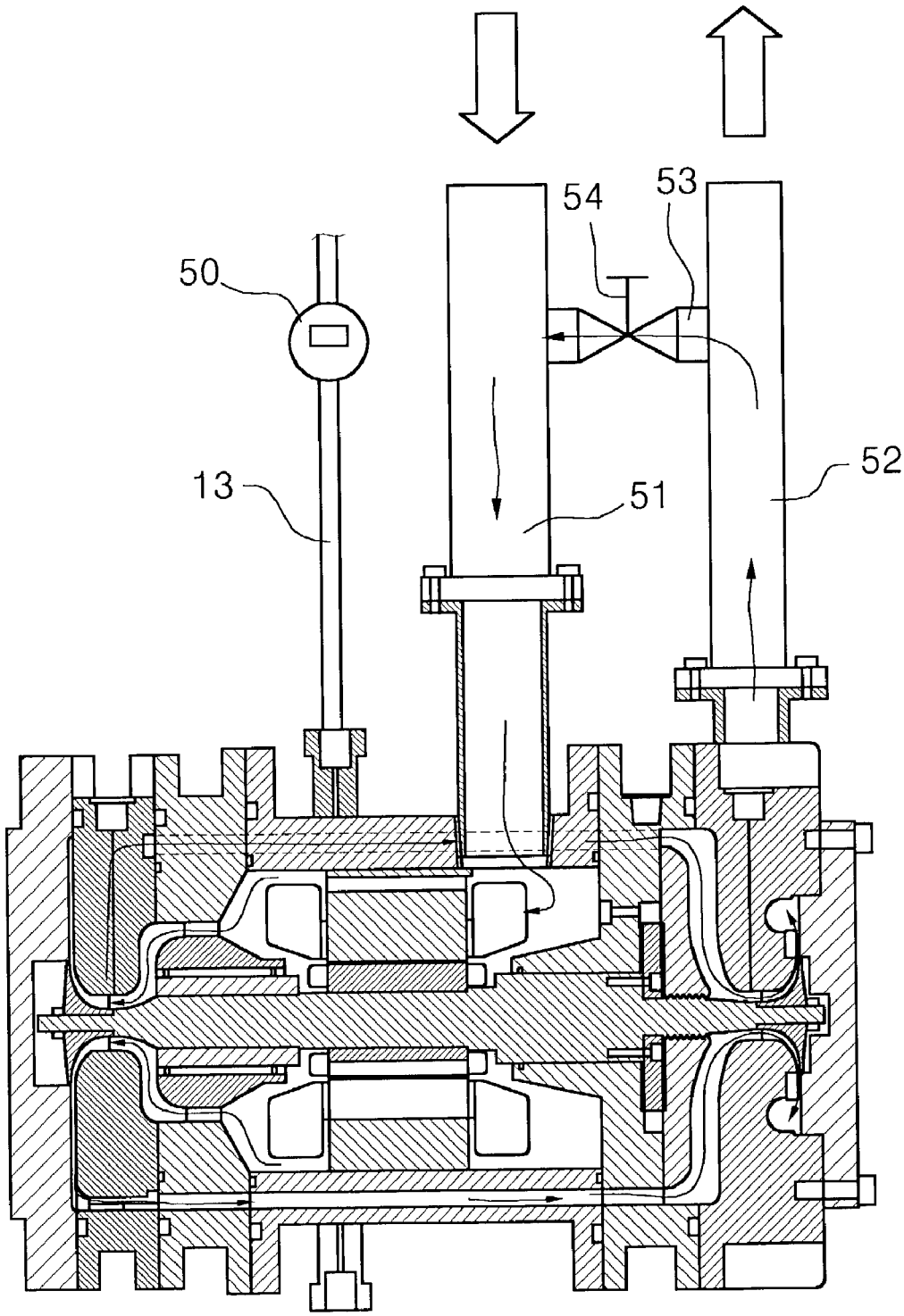
FIG. 5 is a sectional view showing a sudden stop state of a centrifugal compressor in accordance with the present invention.

FIGS. 4 and 5 are views showing an operation of the centrifugal compressor in accordance with the present invention.

FIG. 4 is a view showing a normal operation state of the centrifugal compressor. Referring to FIG. 4, the suction pipe 51 and the discharge pipe 52 are connected to the suction port SP and the discharge port DP, respectively. The fluid passage pipe 53 that connects the suction pipe 51 and the discharge pipe 52 is closed by the bypass valve 54.

In a state that the fluid passage pipe 53 is closed, the low-temperature and low-pressure refrigerant that is sucked through the suction port SP is compressed at two stages and is normally discharged through the discharge port DP in a state of high-temperature and high-pressure.

In case where an operation of the centrifugal compressor is suddenly stopped due to the power failure or the power shutdown caused by the abnormal operation of the centrifugal compressor, the flow of the fluid is instantaneously stopped and flows backward.

FIG. 5 is a view showing a sudden stop state of the centrifugal compressor in accordance with the present invention. Referring to FIG. 5, the power-down detecting unit 50 mounted on the power supplying line 13 detects whether or not the power supplied to the centrifugal compressor is down.

Further, the power-down detecting unit 50 transmits a predetermined signal to the control unit and the control unit transmits a signal to the bypass valve 54 thereby opening the closed bypass valve 54. If the bypass valve 54 is open, the abruptly backward flow of the refrigerant from the discharge port DP to the suction port SP through the refrigerant passage 12 (referring to FIG. 2) is stopped.

After the suction pipe 51 is communicated with the discharge pipe 52 by the open bypass valve 54, the fluid continuously flows through the fluid passage pipe 53 until the pressure equilibrium between the suction port SP and the discharge port DP is achieved.

The reverse rotation preventing structure of the centrifugal compressor in accordance with the present invention reduces the reverse rotation of the rotating shaft and the abnormal flow of the refrigerant in case where the operation of the centrifugal compressor is suddenly stopped, thereby preventing the abnormal noise and the damage to the parts of the centrifugal compressor. Particularly, the centrifugal compressor of the present invention can prevent the degradation of the dynamic-pressure air bearings for supporting a load of the rotating shaft.

Further, the reverse rotation preventing structure of the centrifugal compressor in accordance with the present invention can reduce a long-term stress burdened to the parts of the centrifugal compressor.

Furthermore, the present invention can improve an entire durability and a reliability of the centrifugal compressor.

Although the preferred embodiments of the present invention have been disclosed for illustrative purposes, those skilled in the art will appreciate that various modifications, additions and substitutions can be made without departing from the scope and spirit of the invention as defined in the accompanying claims.

What is claimed is:

1. A reverse rotation preventing structure of a centrifugal compressor, wherein the centrifugal compressor compresses a low-temperature and low-pressure refrigerant sucked through a suction port into a high-temperature and high-pressure refrigerant and discharges the high-temperature and high-pressure refrigerant through a discharge port, the reverse rotation preventing structure comprising:

a suction pipe that extends from the suction port;

a discharge pipe that extends from the discharge port and that discharges fully compressed refrigerant;

a fluid passage pipe that connects the suction pipe and the discharge pipe, to convey fully compressed refrigerant to the suction port from the discharge pipe, wherein an opening and closing of the fluid passage pipe is controlled by a bypass valve mounted on the fluid passage pipe, based on a power-down detecting signal; and a power-down detector that detects a power-down of the centrifugal compressor and generates the power-down detecting signal so that the fully compressed refrigerant is allowed to flow to the suction pipe through the fluid passage pipe, wherein the bypass valve opens without delay upon power down of the centrifugal compressor, to prevent reverse rotation of the centrifugal compressor.

2. The reverse rotation preventing structure of the centrifugal compressor as recited in claim 1, wherein the bypass valve is a check valve.

3. The reverse rotation preventing structure of the centrifugal compressor as recited in claim 1, further comprising a check valve formed at a predetermined location of the discharge pipe between the discharge port and the fluid passage pipe.

4. The reverse rotation preventing structure of the centrifugal compressor as recited in claim 1, further comprising a controller that receives the power-down detecting signal and controls the opening and closing of the bypass valve in response to the power-down detecting signal.

5. The reverse rotation preventing structure of the centrifugal compressor as recited in claim 1, wherein the fluid passage pipe is disposed at a position near to the suction port and the discharge port.

6. The reverse rotation preventing structure of the centrifugal compressor as recited in claim 1, wherein the bypass valve closes when discharge equilibrium between the suction pipe and the discharge pipe is achieved.

7. A reverse rotation preventing structure of a centrifugal compressor, comprising:

a discharge pipeline of the centrifugal compressor that discharges fully compressed refrigerant;

a suction pipeline of the centrifugal compressor;

a bypass pipeline that connects the discharge pipeline and the suction pipeline, a bypass valve being provided along the bypass pipeline;

a controller that controls an operation of the centrifugal compressor based on a predetermined signal; and a detector and generator that generates and transmits the predetermined signal to the controller when the operation of the centrifugal compressor is suddenly stopped, thereby the controller opens the bypass valve of the bypass pipeline, wherein the bypass valve opens without delay when the centrifugal compressor suddenly stops, to prevent reverse rotation of the centrifugal compressor.

8. The reverse rotation preventing structure of the centrifugal compressor as recited in claim 7, wherein the detector and generator detects a power supplied to the centrifugal compressor.

9. The reverse rotation preventing structure of the centrifugal compressor as recited in claim 7, further comprising a check valve that prevents a refrigerant gas remaining in the discharge pipeline from flowing backward from the discharge pipeline to the suction pipeline, the check valve being disposed at a predetermined position of the bypass pipeline.

10. The reverse rotation preventing structure of the centrifugal compressor as recited in claim 7, wherein the predetermined valve is closed during a normal operation of the centrifugal compressor.

11. The reverse rotation preventing structure of the centrifugal compressor as recited in claim 7, wherein the bypass valve closes when pressure equilibrium between the suction pipe and the discharge pipe is achieved.

* * * * *